United States Patent [19]

Wache

[11] Patent Number: 5,036,925

[45] Date of Patent: Aug. 6, 1991

[54] ROTARY HAMMER WITH VARIABLE HAMMERING STROKE

[75] Inventor: Robert Wache, Wiesbaden, Fed. Rep. of Germany

[73] Assignee: Black & Decker Inc., Newark, Del.

[21] Appl. No.: 397,780

[22] Filed: Aug. 22, 1989

[30] Foreign Application Priority Data

Sep. 1, 1988 [DE] Fed. Rep. of Germany ..... 3829683

[51] Int. Cl.[5] ..... E02D 7/02

[52] U.S. Cl. ..... 173/48; 173/104; 173/109; 173/123; 192/53 C

[58] Field of Search ..... 173/48, 13, 14, 18, 173/47, 104, 109, 123; 192/89 A, 53 R, 53 F

[56] References Cited

U.S. PATENT DOCUMENTS

| | | | |
|---|---|---|---|
| 4,280,359 | 7/1981 | Schmid et al. | 173/48 X |
| 4,325,436 | 4/1982 | Richter et al. . | |
| 4,487,272 | 12/1984 | Bleicher et al. | 173/48 X |
| 4,895,212 | 1/1990 | Wache | 173/48 |

FOREIGN PATENT DOCUMENTS

| | | |
|---|---|---|
| 2365117 | 7/1975 | Fed. Rep. of Germany . |
| 2449191 | 5/1976 | Fed. Rep. of Germany . |
| 2917475 | 11/1980 | Fed. Rep. of Germany . |
| 3205141 | 8/1983 | Fed. Rep. of Germany . |
| 3316013 | 11/1984 | Fed. Rep. of Germany . |
| 3423919 | 1/1986 | Fed. Rep. of Germany . |
| 2048753 | 12/1980 | United Kingdom . |

*Primary Examiner*—Timothy V. Eley
*Assistant Examiner*—Willmon Fridie, Jr.
*Attorney, Agent, or Firm*—Dennis A. Dearing; Charles E. Yocum; Edward D. C. Bartlett

[57] ABSTRACT

A rotary hammer has a pneumatic hammering mechanism driven by a wobble plate drive arrangement. A rotatably driven intermediate shaft transmits torque for rotating a tool holder. A carrier sleeve is rotatably mounted on the intermediate shaft and is elastically coupled with the intermediate shaft for limited rotational displacement relative thereto. The tool holder is rotatably driven via gearing by the carrier sleeve. On a suitable portion of the carrier sleeve a hub body of the wobble plate drive is mounted so as to be rotatable relative to the carrier sleeve but non-rotatable in relation to the intermediate shaft. In use, when a hammer bit in the tool holder is placed under load, the carrier sleeve and the intermediate shaft are caused to rotationally displace relative to each other as a result of the elastic coupling, wherein the inclination of the hub body of the wobble plate drive alters and with this the hammering stroke is altered.

19 Claims, 4 Drawing Sheets

ROTARY HAMMER WITH VARIABLE HAMMERING STROKE

FIELD OF THE INVENTION

The invention relates to rotary hammers in which the hammering stroke may be varied to increase or decrease the hammering action.

BACKGROUND OF THE INVENTION

In a proposed rotary hammer (see German Patent Application P32 05 141), the hub body of a wobble plate drive is provided non-rotatably on a cylindrical portion of an intermediate shaft, the longitudinal axis of this cylindrical portion being inclined in relation to the longitudinal axis of the intermediate shaft. In the inner surface of the hub body recesses are provided, which are engaged with projections on the cylindrical portion of the intermediate shaft, resulting in a positive engagement by which a non-rotatable coupling between the intermediate shaft and the hub body is achieved. To vary the hammering stroke of the pneumatic hammering mechanism, the hub body can be physically disengaged from the projections on the cylindrical portion of the intermediate shaft, so that the cylindrical portion can be turned and re-engaged with the projections, resulting in a different position of the hub body on the cylindrical portion of the intermediate shaft. In this way, the inclination of the hub body of the wobble plate drive is altered in the common plane of the longitudinal axis of the intermediate shaft and of the wobble finger provided on the outer race of the wobble plate drive; thus, the stroke of the wobble finger, and thereby also the hammering stroke of the pneumatic hammering mechanism, are altered. This rotary hammer therefore enables the user to manually pre-select and set, before use, a larger or smaller hammering stroke, and therefore apply more or less hammering energy when using the rotary hammer.

Another rotary hammer has been proposed (see German Patent application P 29 17 475), in which the user can alter the hammering stroke of the pneumatic hammering mechanism by altering in use the inclination of a drive plate, mounted so it can swivel on a rotating intermediate shaft, whereby different hammering strokes can be produced.

SUMMARY OF THE INVENTION

An object of the present invention is to provide a rotary hammer in which the hammering stroke automatically adjusts itself dependent on the loading on the rotary hammer, so that a greater hammering stroke is activated upon stronger loading of the rotary hammer.

This object can be achieved by having a wobble member of a wobble plate drive arrangement angularly adjustably mounted on an intermediate shaft by means of a sleeve, the sleeve being rotatably displaceable relative to the intermediate shaft but connected via a resilient arrangement to rotate therewith.

Accordingly, there is provided by the present invention a rotary hammer comprising a rotatable tool holder, a pneumatic hammering mechanism driven by a wobble plate drive arrangement, and a rotatably driven intermediate shaft through which torque for rotating the tool holder is transmitted, the intermediate shaft having a longitudinal axis of rotation. The wobble plate drive has a driven rotating hub body mounted on the intermediate shaft, the hub body, at least in a hammering mode of the rotary hammer, being held non-rotatable relative to the intermediate shaft. A carrier sleeve is rotatably mounted on the intermediate shaft and connected to the latter through a coupling elastically deformable in a circumferential direction about the shaft. The carrier sleeve has a gear portion for transmitting the torque for the tool holder from the intermediate shaft to a rotatable gear element. The hub body is mounted on a portion of the carrier sleeve for rotation relative to the carrier sleeve portion about a longitudinal axis thereof, the carrier sleeve portion longitudinal axis being inclined relative to the intermediate shaft longitudinal axis.

With a rotary hammer according to the invention, the user does not need to carry out any presetting to alter the amplitude of the hammering stroke. Instead, the hammering stroke increases automatically when there is greater loading on the hammer bit, the stroke increasing corresponding to this loading. Thus, automatic adaptation to the respective operation conditions occurs.

The wobble plate drive arrangement preferably has a wobble finger drivingly connected to a reciprocating piston of the pneumatic hammering mechanism, this wobble finger oscillating to and fro during rotation of the carrier sleeve.

With a preferred embodiment of the rotary hammer according to the invention, the normal to the plane of a guiding portion of the hub body and the longitudinal axis of the portion of the carrier sleeve carrying the hub body are inclined to each other, at least over a range of their turning, so that a usual arrangement of a wobble plate drive for a rotary hammer can be used in which an annular body is rotatable, possibly by balls, on the hub body in the plane of the guiding portion, which carries the wobble finger on its outside, and which is in driving engagement with the pneumatic hammering mechanism. If in this type of arrangement the inclinations from the normal to the plane of the guiding portion of the hub body and the longitudinal axis of the portion of the carrier sleeve carrying the hub body are equal, then the stroke of the wobble plate drive, and with that also the hammering stroke of the pneumatic hammering mechanism, is zero, i.e. the result is a plain drilling action of the rotary hammer.

The elastic or resilient coupling between the intermediate shaft and the carrier sleeve may comprise a coil spring, arranged co-axially in relation to the intermediate shaft, of which one end is connected to the intermediate shaft and the other end is connected to the carrier sleeve, so that loading occurring causes twisting between the carrier sleeve and the intermediate shaft with distortion of the coil spring against its spring force.

The gear portion on the carrier sleeve may be formed as a pinion section, while the gear element may be a gear wheel provided on a drill spindle of the rotary hammer.

In order to couple together non-rotatably the hub body, provided rotatably on the carrier sleeve, and the intermediate shaft, these may be engaged with each other via coupling projections. The coupling projections can, on the one side, be formed on an end surface of the hub body and, on the other side, on a driving gear which is fastened non-rotatably on the intermediate shaft.

Other objects, features and advantages of the present invention will become more fully apparent from the following detailed description of the preferred embodiment, the appended claims and the accompanying drawings.

BRIEF DESCRIPTION OF THE DRAWINGS

In the accompanying drawings, in which like reference characters indicate like parts.

DESCRIPTION OF THE PREFERRED EMBODIMENT

Figure 1:
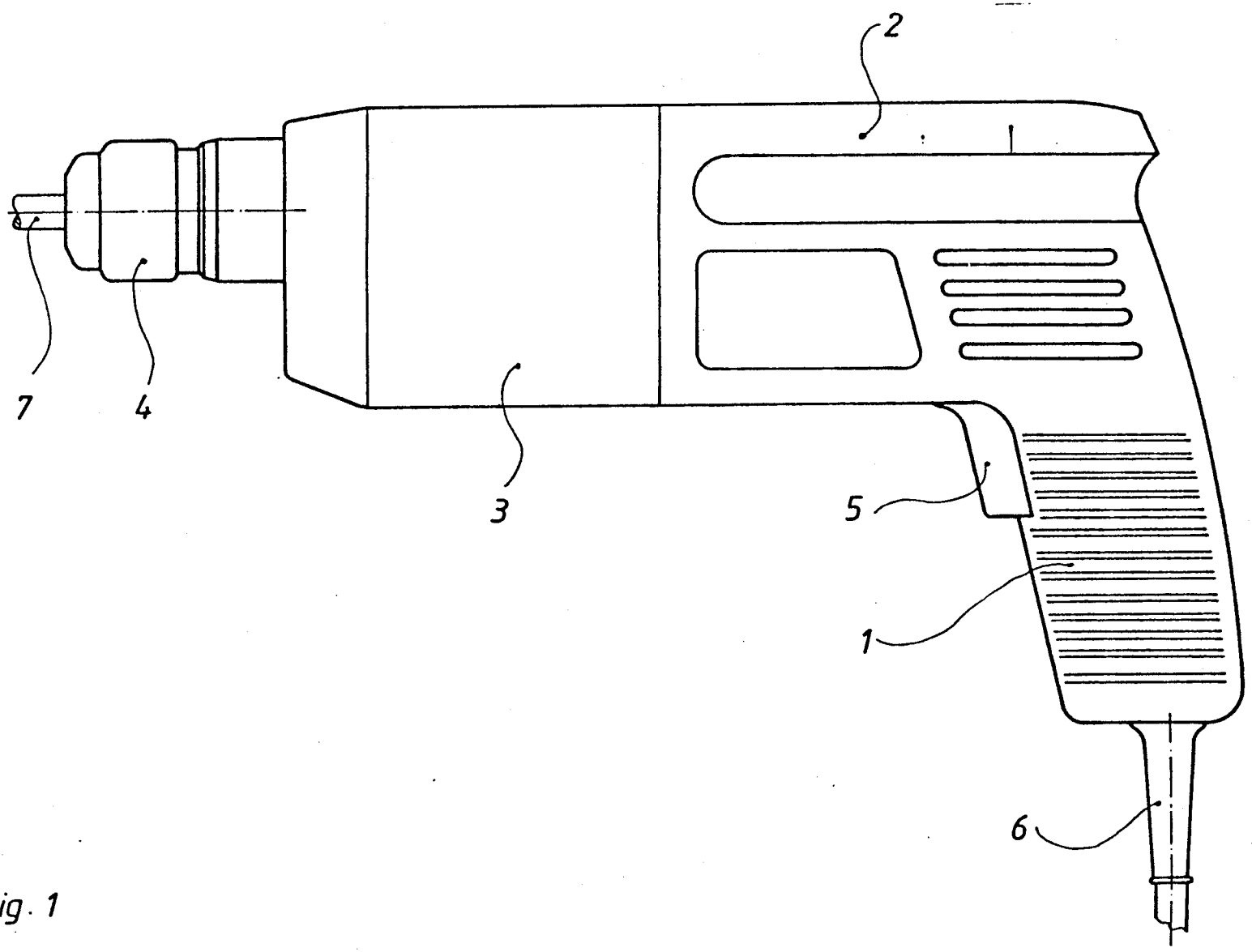
FIG. 1 is a side elevational view of a rotary hammer according to the preferred embodiment of the invention.

The rotary hammer shown has a usual housing, generally formed from half-shells, with a motor housing 2, in which is located an electric motor, and from which a pistol grip handle 1 extends. An actuating element 5 of a trigger switch projects forwardly from the handle 1. The handle 1 is provided with an electrical connection lead 6 to connect the electric motor with a power source. Towards the front of the motor housing 2, a gear housing 3 is attached. A usual tool holder 4, projecting forwardly from the gear housing 3, serves as a holder for the hammer bit 7 shown in FIGS. 1 and 2.

Figure 2:
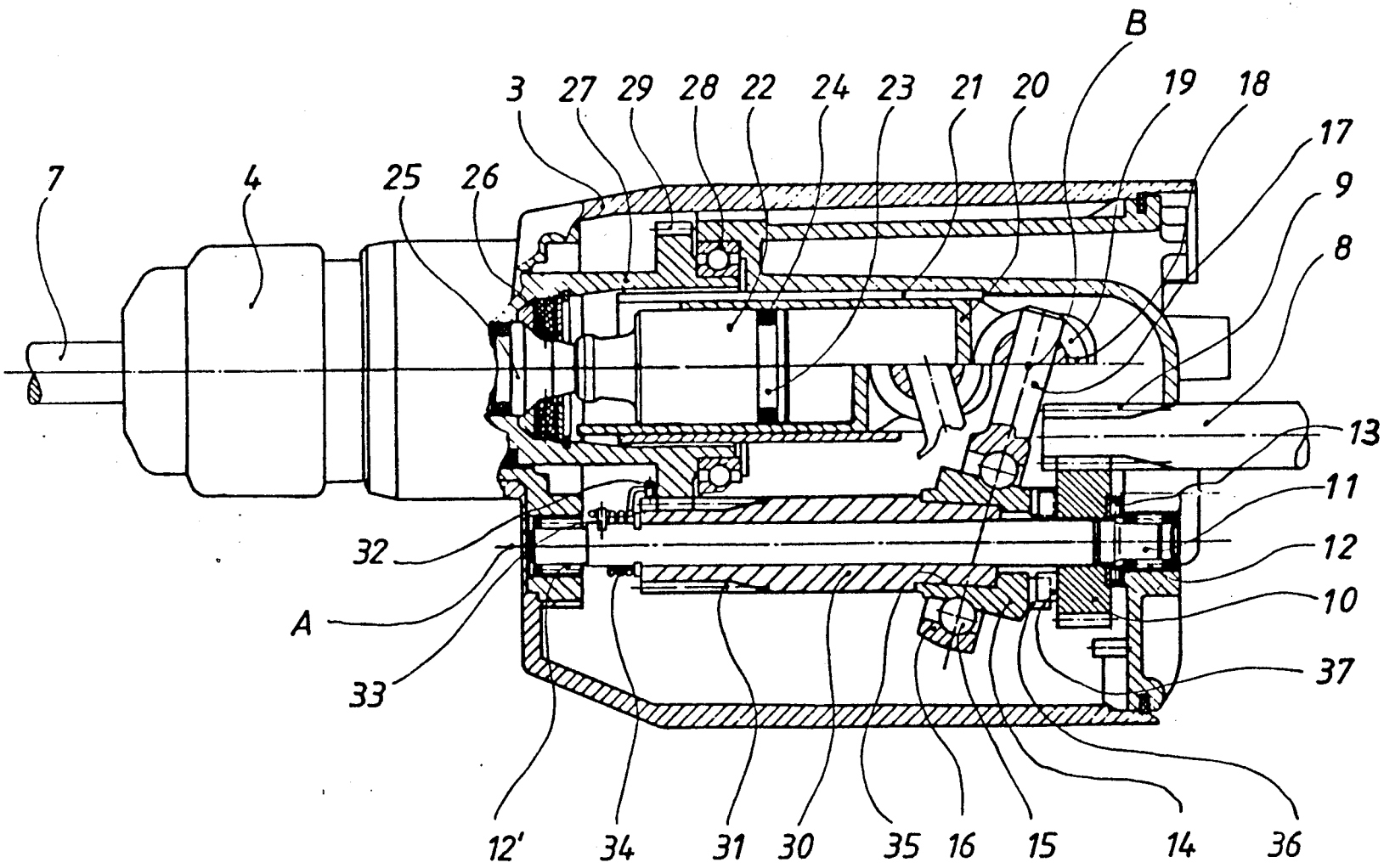
FIG. 2 is partially an elevation and partially a sectional view of the gear housing with the pneumatic hammer mechanism, and the tool holder of the rotary hammer of FIG. 1.

As can be seen in FIG. 2, an intermediate shaft 11, with a longitudinal axis of rotation A, is provided in the gear housing 3. The intermediate shaft 11 has its ends housed in needle bearings 12, 12', and adjacent to the needle bearing 12 there is a further needle bearing 13. A gear 10 is pressed on the rear end of the intermediate shaft 11 journalled in the needle bearing 12, which gear meshes with a pinion 9 of the armature shaft 8 of the electric motor for driving rotation of the intermediate shaft 11.

A carrier sleeve 30 is mounted on the intermediate shaft 11. On the left-hand end (FIG. 2) of carrier sleeve 30, an external gear portion 31 is formed as a pinion, and carrier sleeve 30 is coupled with the intermediate shaft 11 via a resilient or elastic arrangement, preferably comprising a coil spring 34. One end of the coil spring 34 is fastened to a pin 32 extending radially from and inserted in the carrier sleeve 30, and the other end of the coil spring 34 is fastened to a pin 33 extending radially from and inserted in the intermediate shaft 11. This results in the carrier sleeve 30, which is mounted rotatably on and relative to the intermediate shaft 11, being maintained in an angular position relative to the intermediate shaft 11 by the coil spring 34.

The gear portion 31 of the carrier sleeve 30 meshes with a gear wheel 29, which is formed on a drill spindle 27 rotatably mounted in bearing 28. The spindle 27 is coupled in the usual way and therefore not shown, with the tool holder 4 and rotates this in operation.

A hub 14 is mounted, in a manner yet to be described, on a cylindrical portion 35 of the carrier sleeve 30. The hub 14 has coupling projections 36 extending from an end surface at its right-hand end (in FIG. 2) which engage with coupling projections 37 on the gear 10, such that the hub 14 is non-rotatable in relation to the gear 10 and therefore in relation to the intermediate shaft 11. The outer periphery of the hub 14 forms a tilted, inner race for the balls 15 which are retained by an external race 16 so rotatably mounted relative to the hub 14. A wobble finger or pin 17, extending in the direction of the tilt, is attached to the external race 16. The plane of the guiding portion, defined by the position of balls 15 and the alignment of the pin 17, is indicated by the line B. The pin 17 engages with a pivot 18 on the rear end 19 of a hollow piston 20. The type of coupling between the pin 17 and the hollow piston 20 is described, for example, in U.S. Pat. No. 4,280,359. In FIG. 2, the hollow piston 20 is shown in the upper half in its most retracted position, and in the lower half in its most advanced position.

The hollow piston 20 is arranged axially movable in a stationary guiding tube 21. In the piston 20 is a cylindrical-shaped ram 22, movable by sliding, which is in airtight engagement with the inner wall of the hollow piston 20 by means of an O-ring 24 inserted in an annular groove 23 of the ram 22. With a reciprocating movement of the hollow piston 20, an overpressure and an underpressure can be built up alternately between the inner end (on the right in FIG. 2) of the ram 22 and the interior space of the hollow piston 20 bordered by this end. This causes the ram 22 to reciprocate in a known manner so as to exert impacts on the rear end of an intermediate dolly 25 which transmits these impacts to the rear end of the hammer bit 7. It should be mentioned that when the rotary hammer is idling, that is, if the hammer bit 7 is not engaged with a workpiece, a front tapered end of the ram 22 is held in known manner in a forward idle position by the schematically indicated catching device 26.

As already mentioned, the hub 14 of the wobble plate drive formed from this, the balls 15, the race 16 and the pin 17 is mounted on a cylindrical portion 35 of the carrier sleeve 30. This portion 35 is inclined to the longitudinal axis A of the intermediate shaft 11 and correspondingly also to the longitudinal axis of the carrier sleeve 30, so that it has a central axis C (see FIGS. 4 and 5 as well as FIGS. 7 and 8). This central axis C runs with an inclination deviating from the inclination of the normal to the plane B, and the angle of this deviation is denoted by $\gamma$ in FIG. 4. This angle results, as can be seen from FIGS. 3 to 5 for example, when looking at the plane of the drawing in FIG. 2, i.e. that plane in which the wobble arrangement of the race 16 and the pin 17 is tilted backwards and forwards between the two positions shown in FIG. 2; while in a plane displaced by 90 degrees about the longitudinal axis A of the intermediate shaft 11, the axis A and the central axis C of the cylindrical portion 35 of the carrier sleeve 30 appear to coincide with each other, as can be appreciated from FIG. 3.

Figure 3:
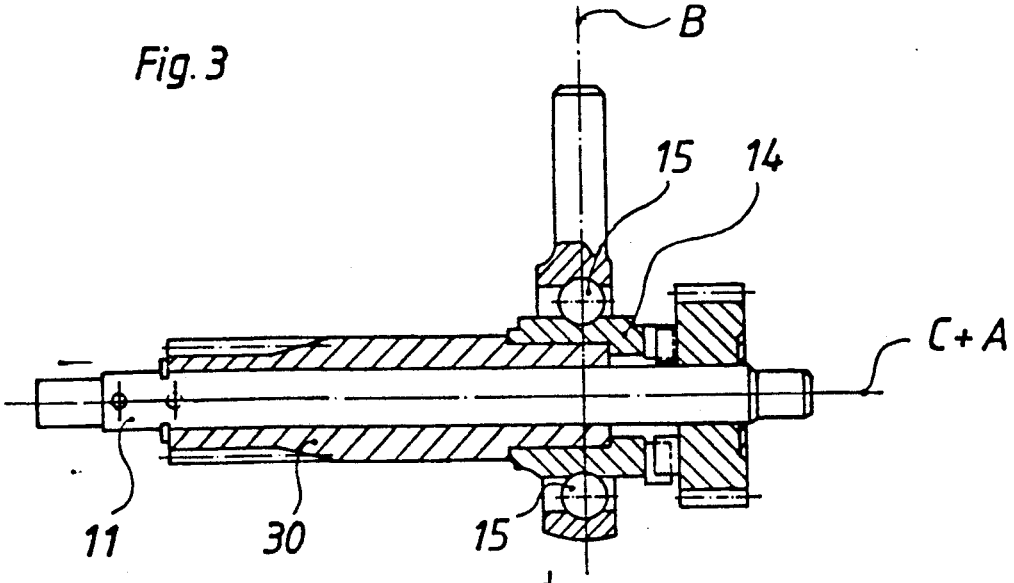
FIGS. 3 to 5 are partial elevations of different operating positions of the intermediate shaft, carrier sleeve and wobble plate drive with an elastic coupling between the intermediate shaft and the carrier sleeve in an unloaded condition.
Figure 4:
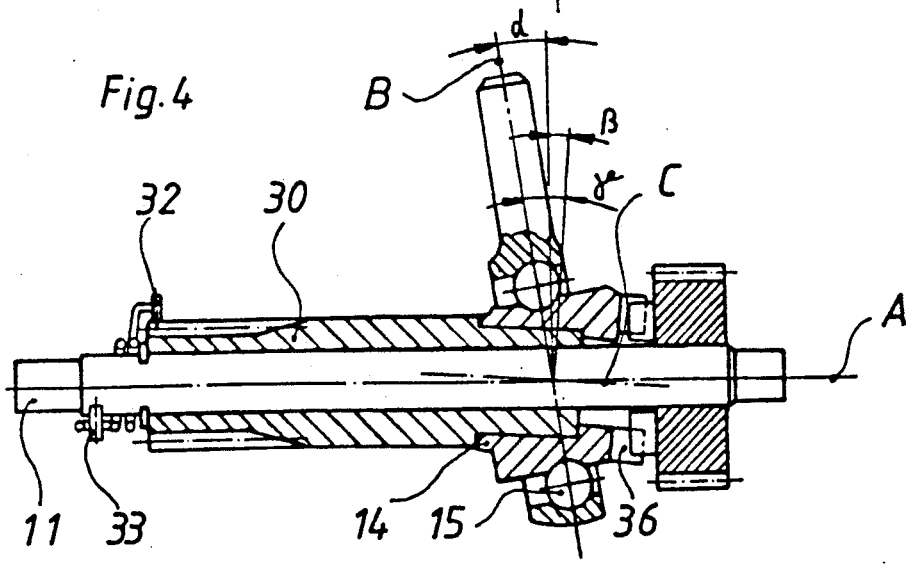
Figure 5:
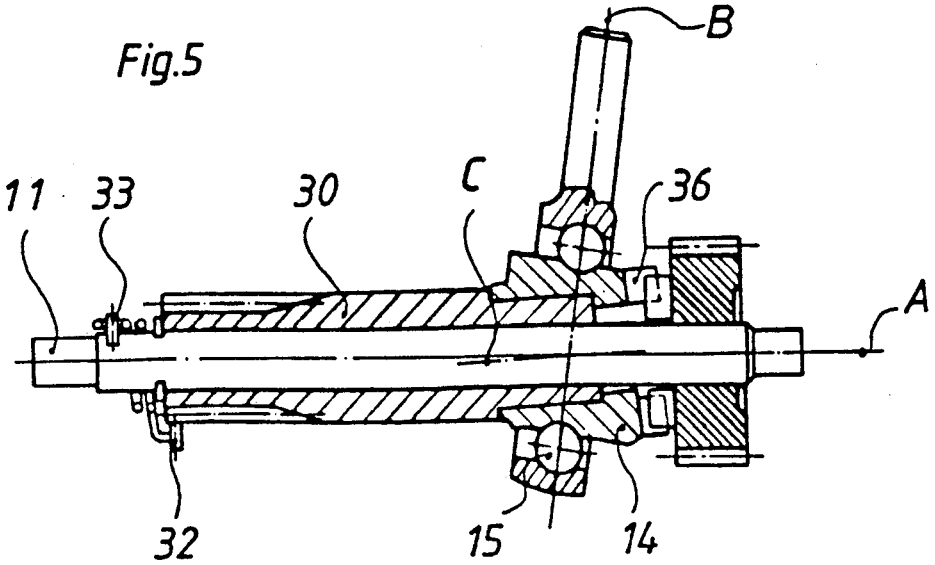

Considering the operating condition according to FIGS. 3 to 5, then one can recognize that both the pins 32 and 33, which hold the coil spring 34, lie in one plane but are located on diametrically opposite sides of the longitudinal axis A of the intermediate shaft 11. This relates to the essentially unloaded state of the coil spring 34. In this operating state, the hub 14 is inclined respectively in both the maximum displacement positions of the pin 17, at an angle $\beta$ to the vertical, i.e. the maximum angle between the longitudinal axis A of the intermediate shaft 11 and the central axis C of the hub 14 amounts to $\beta$. By rotation of the unit comprising the intermediate shaft 11 and the carrier sleeve 30, this angle continuously changes in the plane of the swivel motion of the pin 17 between $+\beta$ and $-\beta$.

The resulting hammering stroke is determined by the Value of the angle $\beta$ and the size of the angle $\gamma$. The angle $\gamma$ is negative in the operating state according to FIGS. 3 to 5. The stroke of the reciprocating movement of the pin 17 amounts to twice $\alpha$ (FIG. 4).

If in use, for example as a result of the introduction of heavy loading by the user or as a result of jamming of the hammer bit 7 in the workpiece, a higher "braking torque" acts on the hammer bit 7, then this causes a braking of the torque through the spindle 27, the gear wheel 29 and the gear portion 31 of the carrier sleeve 30, while the intermediate shaft 11 is still driven by the armature shaft 8 of the electric motor. As a result of this braking effect, the coil spring 34 is loaded and turned in a circumferential direction, so that a relative rotation of the carrier sleeve 30 and the intermediate shaft 11 takes place. This resilient coupling arrangement is such that the greater the loading of the hammer bit 7, the greater the relative rotation of the sleeve 30 about the intermediate shaft 11.

Figure 6:
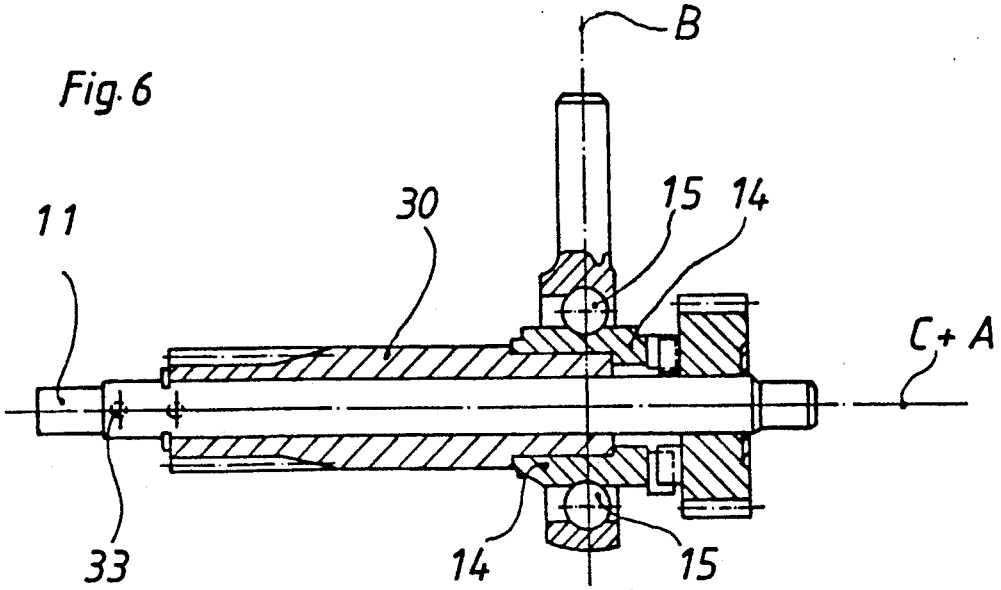
FIGS. 6 to 8 are elevations, corresponding to FIGS. 3 to 5, when the carrier sleeve has been twisted through 180 degrees in relation to the intermediate shaft, resulting from loading of the elastic coupling.
Figure 7:
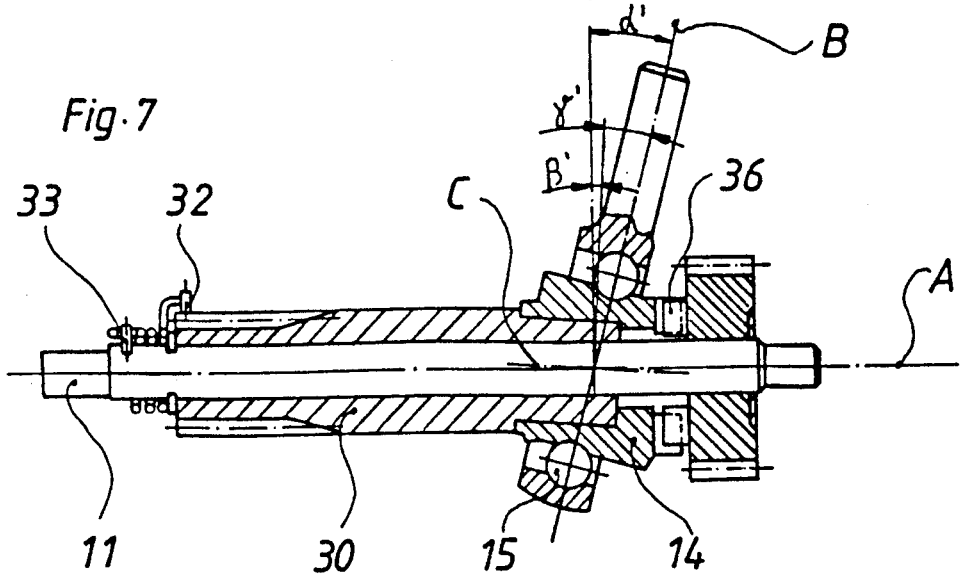
Figure 8:
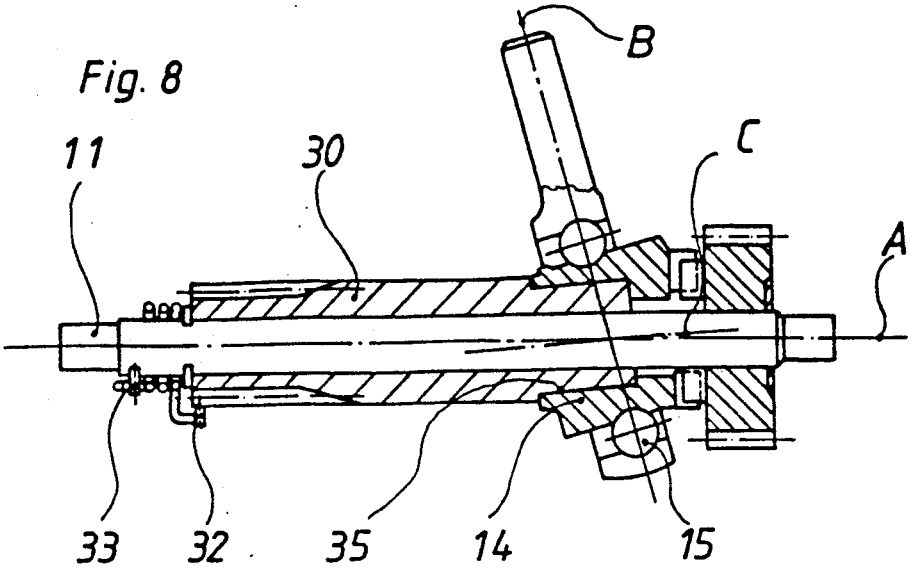

In FIGS. 6 to 8, an example of loading is represented in which the intermediate shaft 11 has been turned 180 degrees relative to the carrier sleeve 30 from the relative positions shown in FIGS. 3 to 5. In FIGS. 6 to 8, both the pins 32 and 33, which hold the coil spring 34, again lie in one plane, but now those pins are on the same side of the longitudinal axis A of the intermediate shaft 11. Through this relative rotation of the carrier sleeve 30 about the intermediate shaft 11, a rotation of the cylindrical portion 35 of the carrier sleeve 30 also takes place relative to the hub 14 of the wobble plate drive; as the hub 14 is coupled non-rotatably to the intermediate shaft 11, at the maximum deflection of the pin 17, the hub 14 remains on a region of the cylindrical portion 35 which effectively now has the angle $\beta'$ in this drive position (e.g. FIG. 7). As can be seen, this angle $\beta'$ is clearly smaller than the angle $\beta$ in FIGS. 3 to 5. However, as in this position the plane B of the guiding portion of the wobble plate drive lies "outside" the angle $\beta'$, there results a stroke of pin 17 of $2\alpha'$ (see FIG. 7) which results from the adding of angles $\beta'$ and $\gamma'$ and is clearly larger than the angle $2\gamma$ in FIGS. 3 to 5 (in which the angle $\gamma$ is in effect negative). That is, in the working state in FIGS. 6 to 8 there is a distinctly increased hammering stroke over that in the working state in FIGS. 3 to 5.

As soon as the "braking load" on the hammer bit 7 is reduced or discontinued, the rotation displacement of the intermediate shaft 11 and the carrier sleeve 30 relative to each other is also reduced, as result of the restoring force of the spring 34; this automatically effects a reduction in the hammering stroke.

It should be mentioned that the cylindrical portion 35 of the carrier sleeve 30 can also be formed in such a way that by minimal rotation relative to each other of the intermediate shaft 11 and the carrier sleeve 30, i.e. with practically unstressed coil spring 34, no hammering stroke results, if in this position the angle between the longitudinal axis A of the intermediate shaft 11 and the central axis of the cylindrical portion 35, that is, the angle $\beta$ is equal to the angle between the normal to plane B and the central axis C, that is equal to the angle $\gamma$.

The above described embodiments, of course, are not to be construed as limiting the breadth of the present invention. Modifications, and other alternative constructions, will be apparent which are within the spirit and scope of the invention as defined in the appended claims.

What is claimed is:

1. A rotary hammer, comprising:

a rotatable tool holder;

a pneumatic hammering mechanism driven by a wobble plate drive arrangement;

a rotatably driven intermediate shaft through which torque for rotating the tool holder is transmitted, said intermediate shaft having a longitudinal axis about which it is rotatable;

said wobble plate drive arrangement including a rotatably driven hub body mounted on said intermediate shaft;

said hub body, at least in a hammering mode of the rotary hammer, being held non-rotatable relative to said intermediate shaft;

a carrier sleeve rotatably mounted on said intermediate shaft and connected to the latter through a coupling elastically deformable in a circumferential direction about said shaft;

said carrier sleeve having a gear portion for transmitting said torque for said tool holder from said intermediate shaft to a rotatable gear element;

said hub body being mounted on a portion of said carrier sleeve for rotation relative to said carrier sleeve portion about a longitudinal axis thereof, said carrier sleeve portion longitudinal axis being inclined relative to said intermediate shaft longitudinal axis;

said pneumatic hammering mechanism driving a reciprocating ram, and whereby rotational displacement of said carrier sleeve relative to said intermediate shaft, due to changes in loading on the tool holder, changes the wobble plate drive arrangement to correspondingly change the hammering stroke of said pneumatic hammering mechanism.

2. The rotary of claim 1, wherein said wobble plate drive arrangement has a wobble finger drivingly connected to a reciprocating piston of the pneumatic hammering mechanism, said wobble finger oscillating to and fro during rotation of said hub body, a central axis of said wobble finger and a normal to said carrier sleeve portion longitudinal axis being inclined in relation to each other, at least during a part of each revolution of said carrier sleeve.

3. The rotary hammer of claim 1, wherein said gear portion comprises a pinion provided on said carrier sleeve.

4. The rotary hammer of claim 1, wherein said gear element comprises a gear wheel provided on a rotatably driven spindle on which said tool holder is mounted.

5. The rotary hammer of claim 1, wherein said hub body and said intermediate shaft are in non-rotatable engagement through coupling projections.

6. A rotary hammer, comprising:

a pneumatic hammering mechanism driven by a wobble plate drive arrangement;

a rotatably driven intermediate shaft having a longitudinal axis about which it rotates;

said wobble plate drive arrangement including a hub member carried by said intermediate shaft, said hub member being rotated with said intermediate shaft to operate said wobble plate drive arrangement;

a carrier rotatably mounted on said intermediate shaft and having a bearing portion upon which said hub member is rotatably mounted, said bearing portion defining a rotational axis about which said hub member is relatively rotatable;

said bearing portion rotational axis being inclined relative to said intermediate shaft longitudinal axis;

a resilient coupling between said carrier and said intermediate shaft to enable said carrier to be rotationally driven by said intermediate shaft while allowing rotational displacement of said carrier about said intermediate shaft; and said resilient coupling comprising a spring, said spring having two ends attached respectively to said intermediate shaft and said carrier.

7. The rotary hammer of claim 6, wherein said spring comprises a coil spring.

8. The rotary hammer of claim 6, wherein said carrier comprises a sleeve, said rotary hammer has a drill spindle, and gearing connects said sleeve to said drill spindle for rotatably driving said drill spindle.

9. The rotary hammer of claim 6, wherein said wobble plate drive arrangement includes a wobble finger having a driving end connected to said pneumatic hammering mechanism and a mounting end rotatably mounted on said hub member for relative rotation thereon about an axis inclined to said bearing portion rotational axis.

10. A rotary hammer, comprising:

a rotatable drill spindle carrying a tool holder;

a hammering mechanism driven by a wobble plate drive arrangement to produce a hammering stroke;

a rotatable intermediate shaft drivingly connected to said drill spindle for rotation thereof via a carrier member mounted on said intermediate shaft;

said wobble plate drive arrangement including a hub member rotatably mounted on a bearing portion of said carrier member, said bearing portion defining a rotational axis which is inclined to a longitudinal axis of said intermediate shaft;

said carrier member being rotatably mounted on said intermediate shaft, but coupled thereto for rotation therewith by a resilient coupling; and said resilient coupling having a part attached to said intermediate shaft and another part attached to said carrier member to enable stressing of said resilient coupling by rotational displacement of said carrier member relative to said intermediate shaft, rotational displacement of said carrier member relative to said intermediate shaft due to change of loading on said drill spindle effecting a corresponding change in said hammering stroke.

11. The rotary hammer of claim 10, wherein said resilient coupling comprises a spring.

12. A rotary hammer, comprising:

a rotatable drill spindle carrying a tool holder;

a hammering mechanism driven by a wobble plate drive arrangement to produce a hammering stroke;

a rotatable intermediate shaft drivingly connected to said drill spindle for rotation thereof via a carrier member mounted on said intermediate shaft;

said wobble plate drive arrangement including a hub member rotatably mounted on a bearing portion of said carrier member, said bearing portion defining a rotational axis which is inclined to a longitudinal axis of said intermediate shaft;

said carrier member being rotatable mounted on said intermediate shaft, but coupled thereto for rotation therewith by a resilient coupling, rotational displacement of said carrier member relative to said intermediate shaft due to change of loading on said drill spindle effecting a corresponding change in said hammering stroke;

said resilient coupling comprising a spring; and said spring comprising a coil spring encircling said intermediate shaft with ends of the coil spring being respectively secured to said intermediate shaft and said carrier member.

13. The rotary hammer of claim 12, wherein said carrier member comprises a sleeve having said bearing portion at one end.

14. The rotary hammer of claim 13, wherein said spring is dispose adjacent an opposite end of said sleeve.

15. The rotary hammer of claim 14, wherein a pinion is formed on said opposite end of said sleeve, said pinion meshing with a gear which rotates said drill spindle.

16. A rotary hammer, comprising:

a hammering mechanism driven by a wobble plate drive arrangement;

a rotatably driven intermediate shaft having an axis about which it rotates;

said wobble plate drive arrangement including a hub member carried by said intermediate shaft, said hub member being rotated with said intermediate shaft to operate said wobble plate drive arrangement;

a carrier rotatable relative to said intermediate shaft and having a bearing portion upon which said hub member is rotatably mounted, said bearing portion defining a rotational axis about which said hub member is relatively rotatable;

said bearing portion rotational axis being inclined with respect to said intermediate shaft axis; and a spring encircling said intermediate shaft and having two ends attached respectively to said intermediate shaft and said carrier to enable said carrier to be rotationally driven by said intermediate shaft via said spring while allowing rotational displacement of said carrier relative to said intermediate shaft in dependence upon changes in load on said spring.

17. A rotary hammer, comprising:

a rotatable tool holder;

a hammering mechanism driven by a wobble plate drive arrangement to produce a hammering stroke;

a rotatably driven intermediate shaft through which torque for rotating the tool holder is transmitted, said intermediate shaft having a longitudinal axis about which it is rotatable;

said wobble plate drive arrangement including a rotatably driven hub body mounted on said intermediate shaft;

said hub body, at least in a hammering mode of the rotary hammer, being held non-rotatable relative to said intermediate shaft;

a carrier sleeve rotatably mounted on said intermediate shaft;

a coil spring encircling said intermediate shaft with ends of the coil spring respectively secured to said intermediate shaft and said carrier sleeve;

said hub body being mounted on a portion of said carrier sleeve for rotation relative to said carrier sleeve portion about a longitudinal axis thereof, said carrier sleeve portion longitudinal axis being inclined relative to said intermediate shaft longitudinal axis; and means for drivingly connecting said carrier sleeve to said tool holder for said rotating of the tool holder whereby rotational displacement of said carrier sleeve relative to said intermediate shaft due to change of loading on said tool holder effects automatically via said coil spring a consequential change in said hammering stroke.

18. A rotary hammer, comprising:

a rotatable tool holder;

a pneumatic hammering mechanism driven by a wobble plate drive arrangement;

a rotatably driven intermediate shaft through which torque for rotating the tool holder is transmitted, said intermediate shaft having a longitudinal axis about which it is rotatable;

said wobble plate drive arrangement including a rotatably driven hub body mounted on said intermediate shaft;

said hub body, at least in a hammering mode of the rotary hammer, being held non-rotatable relative to said intermediate shaft;

a carrier sleeve rotatably mounted on said intermediate shaft and connected to the latter through a coupling elastically deformable in a circumferential direction about said shaft;

said carrier sleeve having a gear portion for transmitting said torque for said tool holder from said intermediate shaft to a rotatable gear element;

said hub body being mounted on a portion of said carrier sleeve for rotation relative to said carrier sleeve portion about a longitudinal axis thereof, said carrier sleeve portion longitudinal axis being inclined relative to said intermediate shaft longitudinal axis; and said elastically deformable coupling comprising a coil spring located coaxially in relation to said intermediate shaft, one end of said coil spring being connected to said intermediate shaft and an other end of said coil spring being connected to said carrier sleeve.

19. A rotary hammer, comprising:

a rotatable tool holder;

a pneumatic hammering mechanism driven by a wobble plate drive arrangement;

a rotatably driven intermediate shaft through which torque for rotating the tool holder is transmitted, said intermediate shaft having a longitudinal axis about which it is rotatable;

said wobble plate drive arrangement including a rotatably driven hub body mounted on said intermediate shaft;

said hub body, at least in a hammering mode of the rotary hammer, being held non-rotatable relative to said intermediate shaft;

a carrier sleeve rotatably mounted on said intermediate shaft and connected to the latter through a coupling elastically deformable in a circumferential direction about said shaft;

said carrier sleeve having a gear portion for transmitting said torque for said tool holder from said intermediate shaft to a rotatable gear element;

said hub body being mounted on a portion of said carrier sleeve for rotation relative to said carrier sleeve portion about a longitudinal axis thereof, said carrier sleeve portion longitudinal axis being inclined relative to said intermediate shaft longitudinal axis;

said hub body and said intermediate shaft being in non-rotatable engagement through coupling projections; and said coupling projections on the one hand being provided on an end surface of said hub body and on the other hand being provided on a driving gear non-rotatably mounted on said intermediate shaft.

* * * * *